US011932586B2

(12) United States Patent
Luo et al.

(10) Patent No.: US 11,932,586 B2
(45) Date of Patent: Mar. 19, 2024

(54) LIQUID EXPLOSIVE FOR IN-SITU EXPLOSIVE FRACTURING IN LOW-PERMEABILITY OILFIELDS AND APPLICATION THEREOF

(71) Applicant: China University of Mining and Technology, Xuzhou (CN)

(72) Inventors: Ning Luo, Xuzhou (CN); Yabo Chai, Xuzhou (CN); Hanliang Liang, Xuzhou (CN); Haohao Zhang, Xuzhou (CN); Cheng Zhai, Xuzhou (CN); Jianan Zhou, Xuzhou (CN); Penglong Li, Xuzhou (CN)

(73) Assignee: China University of Mining and Technology, Xuzhou (CN)

( * ) Notice: Subject to any disclaimer, the term of this patent is extended or adjusted under 35 U.S.C. 154(b) by 0 days.

(21) Appl. No.: 18/354,221

(22) Filed: Jul. 18, 2023

(65) Prior Publication Data

US 2024/0025817 A1 Jan. 25, 2024

(30) Foreign Application Priority Data

Jul. 20, 2022 (CN) ..... 202210861964.X

(51) Int. Cl.
*C06B 25/34* (2006.01)
*C06B 23/00* (2006.01)

(52) U.S. Cl.
CPC ..... *C06B 25/34* (2013.01); *C06B 23/001* (2013.01); *C06B 23/006* (2013.01); *C06B 23/009* (2013.01)

(58) Field of Classification Search
None
See application file for complete search history.

(56) References Cited

U.S. PATENT DOCUMENTS 3,456,589 A 7/1969 Thomison et al.
4,486,317 A * 12/1984 Sandell ..... C06B 47/14 516/107

(Continued)

FOREIGN PATENT DOCUMENTS

CN 108640806 A 10/2018
CN 108997071 A 12/2018
GB 1292653 A 10/1972

OTHER PUBLICATIONS

First Office Action for China Application No. 202210861964.X, dated Feb. 8, 2023.

(Continued)

*Primary Examiner* — Aileen B Felton
(74) *Attorney, Agent, or Firm* — Pilloff Passino & Cosenza LLP; Sean A. Passino; Rachel K. Pilloff

(57) ABSTRACT

A liquid explosive for in-situ explosive fracturing in low-permeability oilfields and application thereof are provided. The liquid explosive includes raw materials in parts by mass: a main explosive with positive oxygen balance, a guest regulator and isolation microcapsules; the main explosive with the positive oxygen balance includes raw materials in parts by mass: monomethylamine nitrate, ammonium nitrate, sodium nitrate, water, guar gum, sodium nitrite, a high-temperature resistant regulator with a low detonation velocity and a surfactant; the guest regulator includes raw materials in parts by mass: a reducing agent and a density regulator; the isolation microcapsules include raw materials in parts by mass: porous hollow microbeads, a pore plugging agent and wall materials of pressure-resistant microcapsules; the guest regulator exists in the porous hollow microbeads of the isolation microcapsules.

4 Claims, 3 Drawing Sheets

(56) References Cited

U.S. PATENT DOCUMENTS

| | | | | |
|---|---|---|---|---|
| 10,793,485 | B2 * | 10/2020 | Quintana Angulo | C06B 47/14 |
| 2016/0052834 | A1 * | 2/2016 | Quintana Angulo | C06B 47/14 264/3.1 |
| 2020/0002241 | A1 * | 1/2020 | Araos | C06B 21/0008 |
| 2022/0242803 | A1 * | 8/2022 | Kettle | C06B 43/00 |

OTHER PUBLICATIONS

Notice of Registration for China Application No. 202210861964.X, dated Mar. 9, 2023.

* cited by examiner

LIQUID EXPLOSIVE FOR IN-SITU EXPLOSIVE FRACTURING IN LOW-PERMEABILITY OILFIELDS AND APPLICATION THEREOF

CROSS-REFERENCE TO RELATED APPLICATIONS

This application claims priority of Chinese Patent Application No. 202210861964.X, filed on Jul. 20, 2022, the entire contents of which are incorporated herein by reference.

TECHNICAL FIELD

The application relates to the technical field of exploiting low-permeability oilfields, and in particular to a liquid explosive for in-situ explosive fracturing in low-permeability oilfields and application thereof.

BACKGROUND

At present, stimulation technologies used in low-permeability oilfields mainly include hydraulic fracturing, high energy gas fracturing, thermochemical oil recovery and explosive fracturing. Compared with quasi-static fracturing technologies such as the hydraulic fracturing, the explosive fracturing overcomes a problem of single fracture extension caused by in-situ stress. However, due to excessive energy release, the explosive fracturing is easy to cause defects such as "stress cage" effects, and explosion in wellbores is easy to damage the wellbores and casings. In exploding in fracture, thin-layer explosives are used to avoid the formation of compaction circles, and the explosion energy directly acts on oil-bearing rock formations, so the exploding in fracture has better effects than high energy gas fracturing and also avoids the wellbore damage caused by the explosion in the wellbores.

The deep oil reservoirs are in a high temperature state, and the explosives at the high temperature are prone to spontaneous combustion and self-explosion due to poor thermal stability and other reasons. Moreover, the high detonation velocity of the explosives is easy to cause excessive damage to rocks and production of the compaction circles. Conventional explosives are mostly in a slightly negative oxygen balance state, and it is difficult to react with crude oils in fractures for in-situ explosive fracturing in low-permeability oil reservoirs, which leads to the consumption of a large number of explosives and the increase of fracturing cost. At present, in the prior art, it is difficult for ordinary industrial explosives to adapt to the high-temperature formations and exploding in fracture because of poor thermal stability and high detonation velocity. Therefore, the ordinary industrial explosives are no longer suitable for exploding in fracture in the low-permeability oilfields.

SUMMARY

An objective of the application is to provide a liquid explosive for in-situ explosive fracturing in low-permeability oilfields and application thereof. In the application, a main explosive with positive oxygen balance reacts with crude oils in-situ to generate a large amount of high-temperature and high-pressure gases to produce multiple fractures.

To achieve the above objective, the present application adopts following technical schemes.

A liquid explosive for in-situ explosive fracturing in low-permeability oilfields includes following raw materials in parts by mass: 83.6-140 parts of a main explosive with positive oxygen balance, 3.5-7 parts of a guest regulator and 31-50 parts of isolation microcapsules;

the main explosive with the positive oxygen balance includes following raw materials in parts by mass: 1-5 parts of monomethylamine nitrate, 50-64 parts of ammonium nitrate, 1-9 parts of sodium nitrate, 10-20 parts of water, 0.5-1.5 parts of guar gum, 0.1-0.5 part of sodium nitrite, 1-5 parts of a high-temperature resistant regulator with a low detonation velocity and 20-35 parts of a surfactant;

the guest regulator includes following raw materials in parts by mass: 2-5 parts of a reducing agent and 1.5-2 parts of a density regulator;

the isolation microcapsules include following raw materials in parts by mass: 15-25 parts of porous hollow microbeads, 8-15 parts of a pore plugging agent and 8-10 parts of wall materials of pressure-resistant microcapsules;

the guest regulator exists in the porous hollow microbeads of the isolation microcapsules.

The isolation microcapsules separate the main explosive with the positive oxygen balance from the guest regulator. The pressure-resistant microcapsules are used to coat the porous hollow microbeads, so as to reduce the breakage of the porous hollow microbeads caused by pumping the explosive.

Through a microencapsulation technology, the porous hollow microbeads are coated with the pressure-resistant microcapsules made of hydrophobic nano-silica to prepare the above-mentioned isolation microcapsules. The microencapsulation technology belongs to the conventional technical means in this field and does not belong to the protection scope of the application, so it is not repeated here.

A method for placing the guest regulator in the porous hollow microbeads of the isolation microcapsules includes following steps: putting the reducing agent and the density regulator, namely the raw materials of the guest regulator, together with the porous hollow microbeads into a high-pressure reaction kettle, and fully stirring for 1-2 hour (h) at a high-pressure environment of 0.5-1 megapascal (MPa) and a rotating speed of 1000-2000 revolutions per minute (rpm), so that the inner cavities of the porous hollow microbeads are filled with the guest regulator; putting the porous hollow microbeads filled with the reducing agent and density regulator into the pore plugging agent, stirring for 5-10 min, then filtering and drying, so that the pore plugging agent plugs micropores on the porous hollow microbeads; coating plugged porous hollow microbeads with the pressure-resistant microcapsules made of hydrophobic nano-silica by using the microencapsulation technology, and obtaining the isolation microcapsules.

In some embodiments, the high-temperature resistant regulator with the low detonation velocity is one or more of sodium sulfate, sodium bisulfate, sodium phosphate, sodium hydrogen phosphate, sodium dihydrogen phosphate, sodium bicarbonate, sodium carbonate, calcium oxalate, sodium oxalate, calcium carbonate and sodium chloride;

the high-temperature resistant regulator with the low detonation velocity is a substance with stable properties which melts, decomposes and absorbs heat at high temperatures after detonation of the explosive.

The surfactant is a polyoxyethylene surfactant, an alkanolamide surfactant or an amine oxide surfactant;

the surfactant as an oil displacement agent is commonly used in chemical flooding, aiming at the oil in the pores of oil reservoirs in oilfield exploitation; activation properties of the surfactant greatly decrease the interfacial tension in oil-water two-phase in the formations, improve the sweep efficiency during the injection of the main explosive with the positive oxygen balance and the oil mixing efficiency of the main explosive with the positive oxygen balance and the crude oils.

In some embodiments, the reducing agent is flammable alcohol; and the density regulator is an acidic solution.

In some embodiments, the flammable alcohol is glycerol and/or ethanol; the acidic solution is citric acid and/or acetic acid.

In some embodiments, the porous hollow microbeads are obtained by perforating floating beads; and the pore plugging agent is a colloidal solution made of gelatin powder, agar or sodium alginate.

The perforating floating beads is a conventional technical means in this field, does not belong to the protection scope of the application, and is not described here.

A preparation method of a liquid explosive for in-situ explosive fracturing in low-permeability oilfields includes following steps: uniformly mixing a main explosive with positive oxygen balance with isolation microcapsules filled with a guest regulator to obtain the liquid explosive for the in-situ explosive fracturing in the low-permeability oilfields.

An application of a liquid explosive for in-situ explosive fracturing in low-permeability oilfields in the in-situ explosive fracturing in the low-permeability oilfields.

In some embodiments, the application comprises following steps:

step 1, pumping the liquid explosive for the in-situ explosive fracturing in the low-permeability oilfields into formations, and mixing and shearing crude oils on walls with the liquid explosive for the in-situ explosive fracturing in the low-permeability oilfields to obtain a mixed explosive; and step 2, pressing a booster explosive into a vertical wellbore for exploitation, so that the booster explosive is connected with the mixed explosive in the formations, igniting, wherein explosion in the wellbore is transferred into the formations and the mixed explosive in the formations explodes and releases high-temperature and high-pressure gas to fracture reservoirs.

The embodiments of the application have the following effects.

In the application, the isolation microcapsules are used to separate the main explosive with the positive oxygen balance from the guest regulator, so that the stability and compatibility of the main explosive with the positive oxygen balance are improved, and moreover, the pH of the solution of the main explosive with the positive oxygen balance is close to neutrality, so as to prevent the solution of the main explosive with the positive oxygen balance from corroding the casing.

When the liquid explosive for the in-situ explosive fracturing in the low-permeability oilfields prepared by the application is injected into shale formations, the liquid explosive is squeezed by rock fractures, and water and oil are separated from the crude oils on the walls by the action of the surfactant in the main explosive with the positive oxygen balance in the rock fractures, and then mixed with the liquid explosive for shearing. Under the action of formation flow shearing, the isolation microcapsules in the liquid explosive are squeezed by the rock fractures, break, and release the coated reducing agent and the coated density regulator; and finally, the oxygen balance, densities, detonation velocities, viscosities, heat resistance and other physical and chemical parameters of the liquid explosive in formation channels are improved.

The liquid explosive provided by the application has the characteristics of good thermal stability, good fluidity, low detonation velocity, high temperature resistance and easy reaction with crude oils.

BRIEF DESCRIPTION OF THE DRAWINGS

In order to more clearly explain the embodiments of the present application, the following will briefly introduce the drawings to be used in the embodiments. Obviously, the drawings in the following description are only some embodiments of the present application. For those of ordinary skill in the art, other drawings may be obtained according to these drawings without any creative effort.

DETAILED DESCRIPTION OF THE EMBODIMENTS

Various exemplary embodiments of the present application are now described in detail, and this detailed description should not be considered as a limitation of the present application, but should be understood as a more detailed description of some aspects, characteristics and embodiments of the present application.

It should be understood that the terminology described in the application is only for describing specific embodiments and is not used to limit the application. In addition, for the numerical range in this application, it should be understood that each intermediate value between the upper limit and the lower limit of the range is also specifically disclosed. The intermediate value within any stated value or stated range and each smaller range between any other stated value or intermediate value within the stated range are also included in this application. The upper and lower limits of these smaller ranges can be independently included or excluded from the range.

Unless otherwise specified, all technical and scientific terms used herein have the same meaning as commonly understood by one of ordinary skill in the art described in the application. Although the application only describes the preferred methods and materials, any methods and materials similar or equivalent to those described herein may also be used in the implementation or testing of the application.

It is obvious to those skilled in the art that many improvements and changes may be made to the specific embodiments of the specification of the application without departing from the scope or spirit of the application. Other implementation methods obtained from the specification of the application are obvious to the skilled person. The specification and embodiments of the application are only exemplary.

The terms "comprising", "including", "having" and "containing" used in the application are all open terms, which means including but not limited to.

Unless otherwise specified, "parts" mentioned in the application are all counted as parts by mass.

Considering that engine oil is easy to obtain, stable in performance and similar in physical properties to crude oils, explosion tests are carried out with the engine oil instead of the crude oils to test the performance of a self-designed explosive. Therefore, in order to make the objective, technical scheme and advantages of the application clearer, the application is further described in detail with embodiments below, but it does not constitute any limitation to the application.

Embodiment 1

Figure 1:
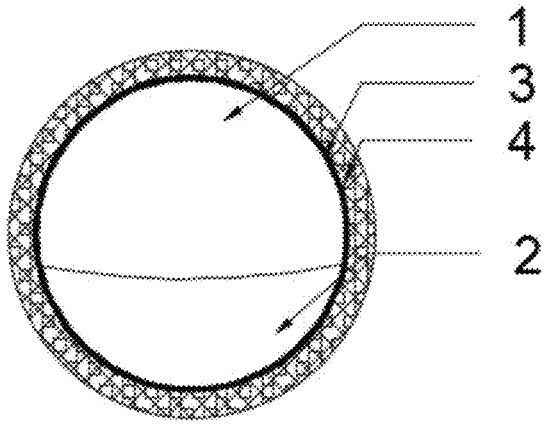
FIG. 1 is a schematic structural diagram of an isolation microcapsule of the application.
Figure 2:
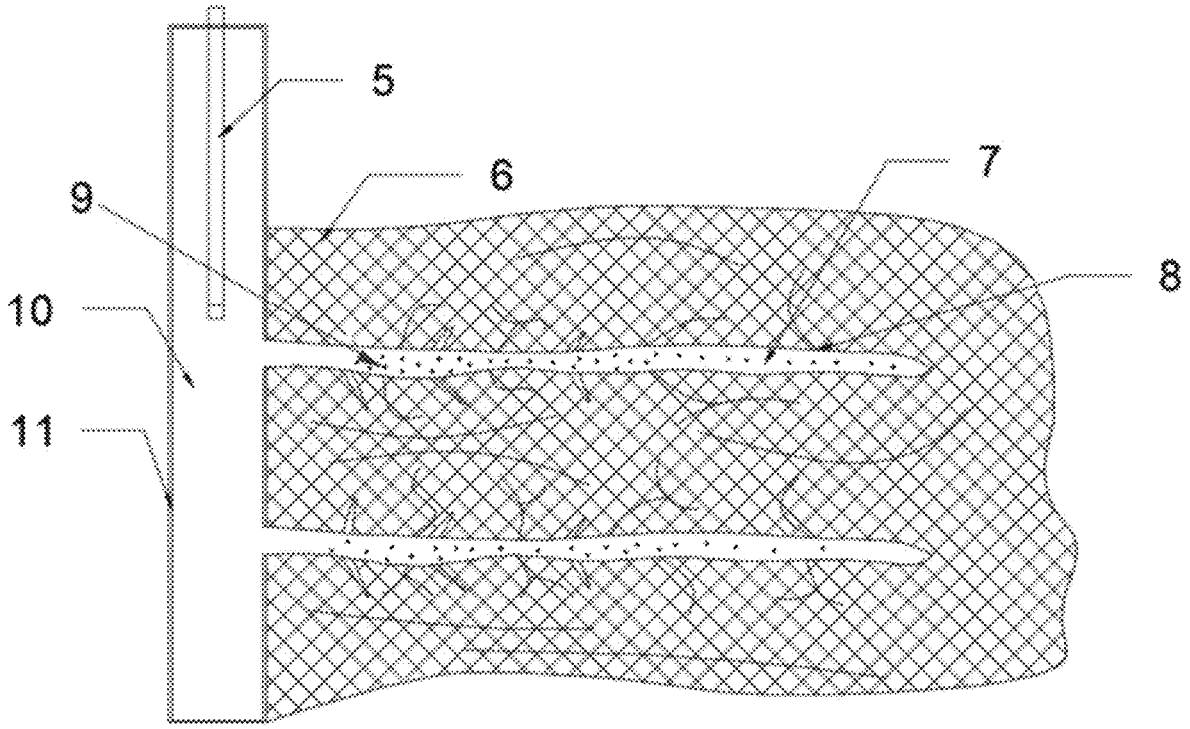
FIG. 2 is a schematic diagram of a construction method of explosive fracturing in formations of the application.
Figure 3:
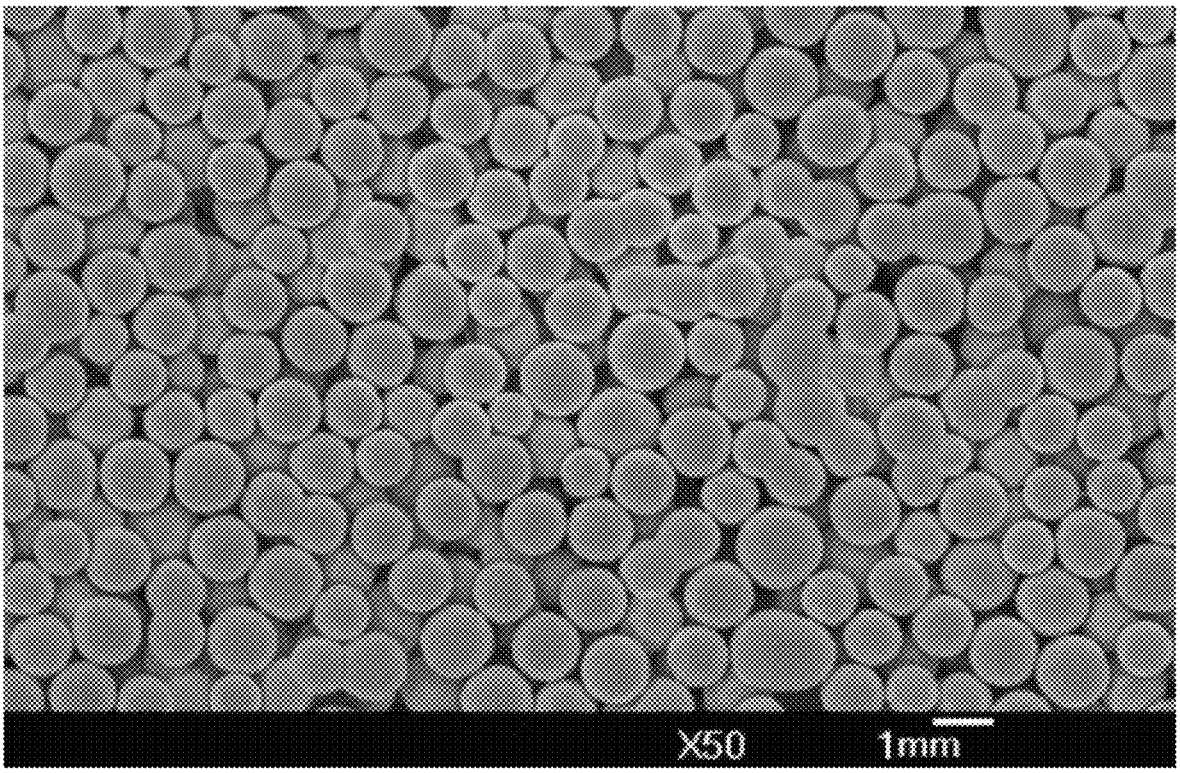
FIG. 3 is a scanning electron microscope (SEM) image of isolation microcapsules prepared in step 2 of Embodiment 1.
Figure 4:
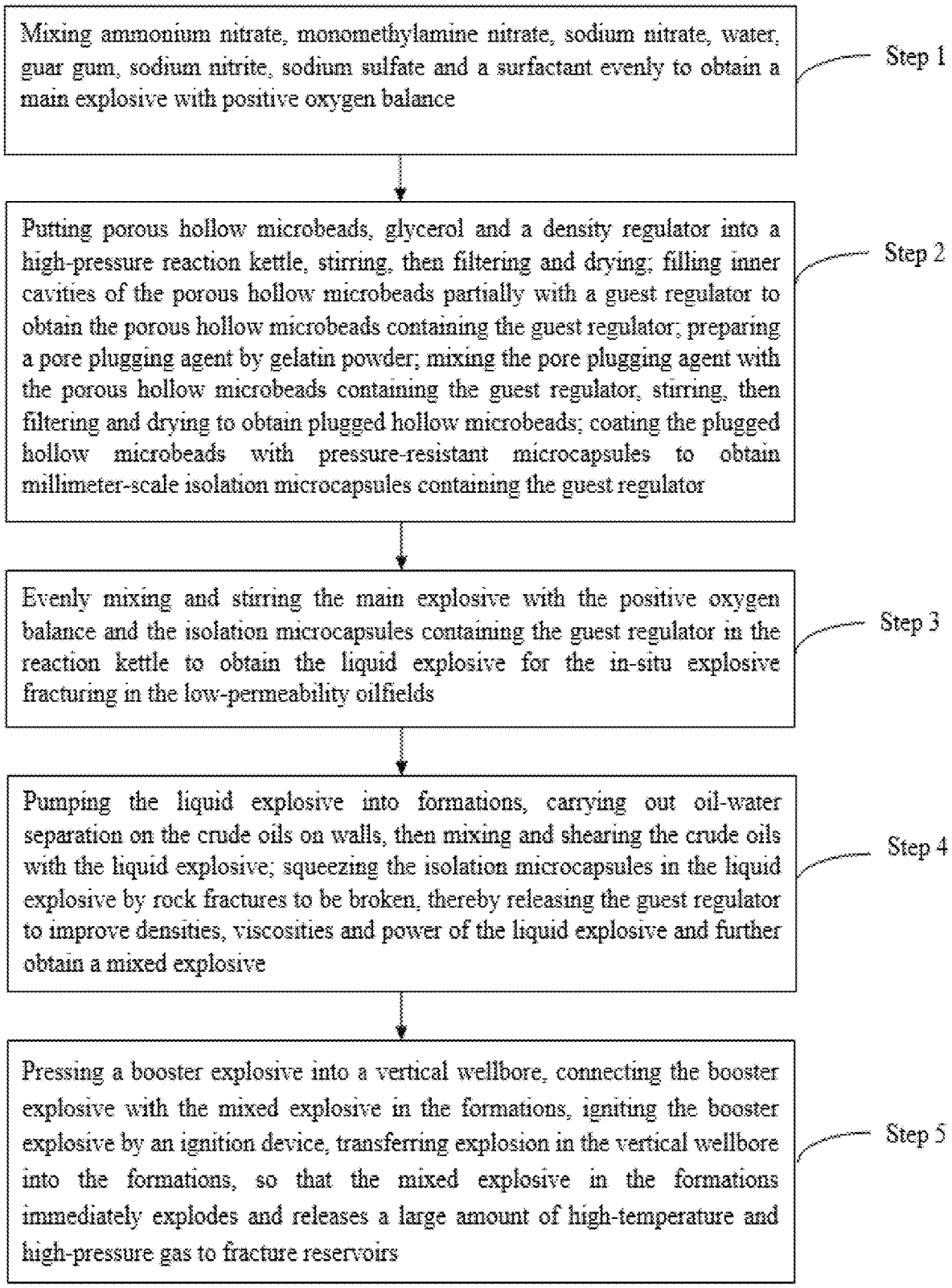
FIG. 4 is a flow chart of a preparation method and an application method of a liquid explosive for in-situ explosion fracturing in low-permeability oilfields of the application.

As shown in FIG. 2 and FIG. 4, a preparation method and an application method of a liquid explosive for in-situ explosion fracturing in low-permeability oilfields include following steps:

step 1: 640 grams (g) of ammonium nitrate, 10 g of monomethylamine nitrate, 90 g of sodium nitrate, 200 g of water, 10 g of guar gum, 5 g of sodium nitrite, 30 g of sodium sulfate and 350 g of emulsifier EL-90 namely a surfactant are weighed and mixed evenly to obtain a main explosive with positive oxygen balance (hereinafter referred to as an explosive with positive oxygen balance);

step 2: 150 g of porous hollow microbeads, 40 g of glycerol and 20 g of a density regulator are put into a high-pressure reaction kettle, stirred for 1 h at a reaction pressure of 0.5 MPa and a rotation speed of 1000 rpm, then filtered and dried; then, inner cavities of the porous hollow microbeads 1 are partially filled with a guest regulator 2 (glycerol+acetic acid); and the porous hollow microbeads containing the guest regulator are obtained; 100 g of gelatin powder is prepared into a gelatin solution namely a pore plugging agent 3 with a mass concentration of 1.05 gram per cubic centimeter ($g/cm^3$); the pore plugging agent 3 is mixed with the porous hollow microbeads containing the guest regulator, stirred for 8 minutes (min), filtered and dried to obtain plugged hollow microbeads; and then, the plugged hollow microbeads are coated with 100 g of pressure-resistant microcapsules 4 made of hydrophobic nano-silica by a microencapsulation technology to obtain millimeter-scale isolation microcapsules containing the guest regulator with an average diameter of 0.1-2 millimeter (mm), as shown FIG. 1 and FIG. 3;

step 3: the explosive with the positive oxygen balance prepared in the step 1 and the isolation microcapsules containing the guest regulator prepared in the step 2 are evenly mixed and stirred in the reaction kettle to obtain the liquid explosive for the in-situ explosive fracturing in the low-permeability oilfields;

step 4: the liquid explosive prepared in the step 3 is pumped into formations 6, and water and oil are separated from the crude oils 8 on the walls under an action of the surfactant in slits, and then is mixed and sheared with the liquid explosive; the isolation microcapsules 9 in the liquid explosive are squeezed by rock fractures 7, break, and thereby release the guest regulator 2 to improve densities, viscosities and power of the liquid explosive and further obtain a mixed explosive; and step 5: a booster explosive 10 is pressed into a vertical wellbore 11 for shale oil exploitation, the booster explosive is connected with the mixed explosive in the formations 6, the booster explosive in the vertical wellbore is ignited by an ignition device 5, explosion in the vertical wellbore is transferred into the formations, and the mixed explosive in the formations immediately explodes and releases a large amount of high-temperature and high-pressure gas to fracture reservoirs, where the above-mentioned booster explosive is an explosive used in fracturing technology to ignite the mixed explosive in the formations, which is not within the patent scope of the application, and is not repeated here and in the following embodiments.

Embodiment 2

A preparation method and an application method of a liquid explosive for in-situ explosion fracturing in low-permeability oilfields includes following steps:

step 1: 580 g of ammonium nitrate, 50 g of monomethylamine nitrate, 90 g of sodium nitrate, 200 g of water, 10 g of guar gum, 5 g of sodium nitrite, 40 g of sodium bisulfate and 300 g of emulsifier EL-90 namely a surfactant are weighed and mixed evenly to obtain an explosive with positive oxygen balance;

step 2: 100 g of porous hollow microbeads, 20 g of glycerol and 15 g of citric acid are put into a high-pressure reaction kettle, stirred for 1.5 h at a reaction pressure of 0.5 MPa and a rotation speed of 1500 rpm, then filtered and dried; then, inner cavities of the porous hollow microbeads 1 are partially filled with a guest regulator 2 (glycerol+citric acid); and the porous hollow microbeads containing the guest regulator are obtained; 120 g of agar is prepared into a agar gel solution namely a pore plugging agent 3 with a mass concentration of 1.2 $g/cm^3$; the pore plugging agent 3 is mixed with the porous hollow microbeads containing the guest regulator, stirred for 8 min, filtered and dried to obtain plugged hollow microbeads; and then, the plugged hollow microbeads are coated with 80 g of pressure-resistant microcapsules 4 made of hydrophobic nano-silica by a microencapsulation technology to obtain millimeter-scale isolation microcapsules containing the guest regulator.

step 3: the explosive with the positive oxygen balance prepared in the step 1 and the isolation microcapsules containing the guest regulator prepared in the step 2 are evenly mixed and stirred in the reaction kettle to obtain the liquid explosive for the in-situ explosive fracturing in the low-permeability oilfields;

step 4: the liquid explosive prepared in the step 3 is pumped into formations 6, and water and oil are separated from the crude oils 8 on the walls under an action of the surfactant in slits, and then is mixed and sheared with the liquid explosive; the isolation microcapsules 9 in the liquid explosive are squeezed by rock fractures 7, break, and thereby release the guest regulator 2 to improve densities, viscosities and heat resistance of the liquid explosive and further obtain a mixed explosive; and step 5: a booster explosive 10 is pressed into a vertical wellbore 11 for shale oil exploitation, the booster explosive is connected with the mixed explosive in the formations 6, the booster explosive in the vertical wellbore is ignited by an ignition device 5, explosion in the vertical wellbore is transferred into the formations, and the mixed explosive in the formations immediately explodes and releases a large amount of high-temperature and high-pressure gases to fracture reservoirs.

Embodiment 3

A preparation method and an application method of a liquid explosive for in-situ explosion fracturing in low-permeability oilfields includes following steps:

step 1: 700 g of ammonium nitrate, 50 g of monomethylamine nitrate, 40 g of sodium nitrate, 130 g of water, 10 g of guar gum, 2 g of sodium nitrite, 40 g of sodium bicarbonate and 350 g of emulsifier EL-90 namely a surfactant are weighed and mixed evenly to obtain an explosive with positive oxygen balance;

step 2: 80 g of porous hollow microbeads, 23 g of glycerol and 15 g of citric acid are put into a high-pressure reaction kettle, stirred for 1.5 h at a reaction pressure of 0.5 MPa and a rotation speed of 1500 rpm, then filtered and dried; then, inner cavities of the porous hollow microbeads 1 are partially filled with a guest regulator 2 (glycerol+citric acid); and the porous hollow microbeads containing the guest regulator are obtained; 100 g of sodium alginate is prepared into a colloidal solution namely a pore plugging agent 3 with a mass concentration of 1.35 g/cm$^3$; the pore plugging agent 3 is mixed with the porous hollow microbeads containing the guest regulator, stirred for 8 min, filtered and dried to obtain plugged hollow microbeads; and then, the plugged hollow microbeads are coated with 80 g of pressure-resistant microcapsules 4 made of hydrophobic nano-silica by a microencapsulation technology to obtain millimeter-scale isolation microcapsules containing the guest regulator.

step 3: the explosive with the positive oxygen balance prepared in the step 1 and the isolation microcapsules containing the guest regulator prepared in the step 2 are evenly mixed and stirred in the reaction kettle to obtain the liquid explosive for the in-situ explosive fracturing in the low-permeability oilfields;

step 4: the liquid explosive prepared in the step 3 is pumped into formations 6, and water and oil are separated from the crude oils 8 on the walls under an action of the surfactant in slits, and then is mixed and sheared with the liquid explosive; the isolation microcapsules 9 in the liquid explosive are squeezed by rock fractures 7, break, and thereby release the guest regulator 2 to improve densities, viscosities and heat resistance of the liquid explosive and further obtain a mixed explosive; and step 5: a booster explosive 10 is pressed into a vertical wellbore 11 for shale oil exploitation, the booster explosive is connected with the mixed explosive in the formations 6, the booster explosive in the vertical wellbore is ignited by an ignition device 5, explosion in the vertical wellbore is transferred into the formations, and the mixed explosive in the formations immediately explodes and releases a large amount of high-temperature and high-pressure gases to fracture reservoirs.

Basic physical and chemical properties parameters of liquid explosives for in-situ explosive fracturing in low-permeability oilfields prepared in the step 3 of the embodiment 1, the embodiment 2 and the embodiment 3 of the application are shown in Table 1.

TABLE 1

| Physicochemical property | Embodiment 1 | Embodiment 2 | Embodiment 3 |
|---|---|---|---|
| Absolute viscosity (cp) | 5300 | 5350 | 5400 |
| Density (kg/m$^3$) | 1.1 | 1.2 | 1.3 |
| Detonation velocity (m/s) | 2100-2400 | 2200-2500 | 2300-2600 |
| High temperature resistance (° C.) | 60 | 63 | 65 |
| Impact sensitivity | Explosion probability <0.5% | Explosion probability <0.5% | Explosion probability <0.5% |
| Friction sensitivity | Explosion probability <0.2% | Explosion probability <0.2% | Explosion probability <0.2% |
| Storage period (month) | >2 months | >2 months | >2 months |

Fracturing effects of the liquid explosive prepared in the embodiment 1 after high-energy initiation are as follows:

through explosion tests of similar concrete materials, a cement target is made according to Specification of making concrete targets for well perforators test SY/5891.1-1999, explosion of 1 kilogram (kg) of the liquid explosive produces two fractures on a target surface, a length of the first fracture is less than 0.5 meter (m), and the second fracture is not obvious; the explosion of 4.5 kg of the liquid explosive produces four fractures on the target surface, of which lengths of three fractures are more than 1.5 m and a length of a remaining fracture is less than 1 m.

The liquid explosive for the in-situ explosive fracturing in the low-permeability oilfields prepared by the application may effectively enter the vertical shaft land the rock fractures 7 because of good fluidity (150-180 megapascal per second (MPa·s) at room temperature, 155 MPa·s in the embodiment 1, 165 MPa·s in the embodiment 2 and 175 MPa·s in the embodiment 3). According to field experiments, shock wave generated by the high-energy initiation may effectively improve rock breaking and produce effective fractures in the rock mass.

In the application, the high-temperature and high-pressure gases (high temperature above 800 degree Celsius (° C.) and high pressure above 100 MPa) generated by the explosion of the liquid explosive for many times forms pulse loading, a pressure rising speed is controlled, multi-directional fractures are produced near the wellbore and communicates with natural fractures, so as to increase production and injection.

It should be understood that the technical schemes of the present application are not limited to the above specific embodiments, and any technical variations made according to the technical solutions of the present application, without departing from the protection scope defined by claims of the present application, shall fall within the scope of protection of the present application.

What is claimed is:

1. A liquid explosive for in-situ explosive fracturing in low-permeability oilfields, comprising raw materials in parts by mass: 83.6-140 parts of a main explosive with positive oxygen balance, 3.5-7 parts of a guest regulator, and 31-50 parts of isolation microcapsules;

according to parts by mass, raw materials of the main explosive with the positive oxygen balance comprise: 1-5 parts of monomethylamine nitrate, 50-64 parts of ammonium nitrate, 1-9 parts of sodium nitrate, 10-20 parts of water, 0.5-1.5 parts of guar gum, 0.1-0.5 part of sodium nitrite, 1-5 parts of a high-temperature resistant regulator with a low detonation velocity and 20-35 parts of a surfactant;

according to parts by mass, raw materials of the guest regulator comprise: 2-5 parts of a reducing agent and 1.5-2 parts of a density regulator;

according to parts by mass, raw materials of the isolation microcapsules comprise: 15-25 parts of porous hollow microbeads, 8-15 parts of a pore plugging agent and 8-10 parts of wall materials of pressure-resistant microcapsules;

the guest regulator exists in the porous hollow microbeads of the isolation microcapsules;

the high-temperature resistant regulator with the low detonation velocity is one or more of sodium sulfate, sodium bisulfate, sodium phosphate, sodium hydrogen phosphate, sodium dihydrogen phosphate, sodium bicarbonate, sodium carbonate, calcium oxalate, sodium oxalate, calcium carbonate and sodium chloride;

the surfactant is a polyoxyethylene, alkanolamide or amine oxide surfactant;

the reducing agent is flammable alcohol; and the density regulator is an acidic solution;

the flammable alcohol is glycerol or ethanol; the acidic solution is citric acid or acetic acid; and the porous hollow microbeads are obtained by perforating floating beads; and the pore plugging agent is a colloidal solution made of gelatin powder, agar or sodium alginate.

2. A preparation method of the liquid explosive for in-situ explosive fracturing in low-permeability oilfields according to claim 1, comprising a following step: uniformly mixing a main explosive with positive oxygen balance with isolation microcapsules filled with a guest regulator to obtain the liquid explosive for the in-situ explosive fracturing in the low-permeability oilfields.

3. An application of the liquid explosive for in-situ explosive fracturing in low-permeability oilfields according to claim 1 in the in-situ explosive fracturing in the low-permeability oilfields.

4. The application according to claim 3, wherein the application comprises following steps:

step 1, pumping the liquid explosive for the in-situ explosive fracturing in the low-permeability oilfields into formations, and mixing and shearing crude oils on walls with the liquid explosive for the in-situ explosive fracturing in the low-permeability oilfields to obtain a mixed explosive; and step 2, pressing a booster explosive into a vertical wellbore for exploitation, so that the booster explosive is connected with the mixed explosive in the formations, and igniting, wherein explosion in the wellbore is transferred into the formations and the mixed explosive in the formations explodes and releases high-temperature and high-pressure gases to fracture reservoirs.

* * * * *